US011821674B2

(12) United States Patent
Fei et al.

(10) Patent No.: US 11,821,674 B2
(45) Date of Patent: Nov. 21, 2023

(54) REFRIGERATOR

(71) Applicant: QINGDAO HAIER JOINT STOCK CO., LTD., Qingdao (CN)

(72) Inventors: Bin Fei, Qingdao (CN); Dengqiang Li, Qingdao (CN); Xueli Cheng, Qingdao (CN); Yazhou Shang, Qingdao (CN)

(73) Assignee: QINGDAO HAIER JOINT STOCK CO., LTD., Qingdao (CN)

( * ) Notice: Subject to any disclaimer, the term of this patent is extended or adjusted under 35 U.S.C. 154(b) by 1056 days.

(21) Appl. No.: 16/610,065

(22) PCT Filed: Jun. 28, 2018

(86) PCT No.: PCT/CN2018/093287
§ 371 (c)(1),
(2) Date: Oct. 31, 2019

(87) PCT Pub. No.: WO2019/001504
PCT Pub. Date: Jan. 3, 2019

(65) Prior Publication Data

US 2023/0117109 A1 Apr. 20, 2023

(30) Foreign Application Priority Data

Jun. 29, 2017 (CN) ..... 201710517041.1

(51) Int. Cl.
*F25D 17/08* (2006.01)
*F25D 17/06* (2006.01)

(52) U.S. Cl.
CPC ..... *F25D 17/08* (2013.01); *F25D 17/062* (2013.01); *F25D 2317/067* (2013.01); *F25D 2317/0681* (2013.01)

(58) Field of Classification Search
CPC .. F25D 17/065; F25D 17/08; F25D 2317/067; F25D 2317/0681; F25D 2317/0683; F25D 2323/0028; F25D 17/062
See application file for complete search history.

(56) References Cited

U.S. PATENT DOCUMENTS

| | | | | |
|---|---|---|---|---|
| 5,033,182 | A | 7/1991 | Winterheimer et al. | |
| 8,919,145 | B2 | 12/2014 | Bortoletto et al. | |
| 2016/0273823 | A1* | 9/2016 | Cho | F25D 17/067 |

FOREIGN PATENT DOCUMENTS

| | | | |
|---|---|---|---|
| CN | 1892155 | A | 1/2007 |
| CN | 103644693 | A | 3/2014 |
| CN | 203478791 | U | 3/2014 |
| CN | 105605848 | A | 5/2016 |
| CN | 105758093 | A | 7/2016 |
| CN | 106196835 | A | 12/2016 |
| CN | 106440629 | A | 2/2017 |
| CN | 106546048 | A | 3/2017 |
| CN | 106642934 | A | 5/2017 |

(Continued)

*Primary Examiner* — Cassey D Bauer
(74) *Attorney, Agent, or Firm* — Cheng-Ju Chiang

(57) ABSTRACT

Provided in the application is a refrigerator. The refrigerator may comprise: a cabinet having a cooling chamber and at least one storage chamber, and an air duct assembly installed on the cabinet. The air duct assembly has a plurality of air duct layers sequentially arranged in a longitudinal direction of the cabinet and each of the air duct layers has one or more air ducts.

9 Claims, 6 Drawing Sheets

(56) References Cited

FOREIGN PATENT DOCUMENTS

| | | | |
|---|---|---|---|
| CN | 107192198 | A | 9/2017 |
| IN | 104236195 | A | 12/2014 |
| JP | 2005-221144 | A | 8/2005 |
| KR | 10-0759043 | B1 | 9/2007 |

* cited by examiner

REFRIGERATOR

The present application is a 35 U.S.C. § 371 National Phase conversion of International (PCT) Patent Application No. PCT/CN2018/093287, filed on Jun. 28, 2018, which claims priority to Chinese Patent Application No. 201710517041.1, filed on Jun. 29, 2017 and tiled "Refrigerator", which is incorporated herein by reference in its entirety. The PCT International Patent Application was filed and published in Chinese.

TECHNICAL FIELD

The application relates to the field of storage by refrigerating and freezing, in particular to a refrigerator.

BACKGROUND

In recent years, with improvements in people's living standards and increases in the environmental awareness, the requirements on refrigerators are shifted from low-temperature refrigeration to freshness-keeping performance of the food. Therefore, air-cooled refrigerators gradually become popular to the people. For the air-cooled refrigerator, the freshness-keeping performance of the food depends to a large extent on air circulation in a storage chamber of the air-cooled refrigerator and temperature differences between respective sections of the refrigerator body. When the air circulation manner in the refrigerator body is reasonable, the smaller the temperature difference, the better the freshness-keeping performance of the refrigerator. An air passage is the key component that determines whether the air circulation manner of the refrigerator is reasonable, which determines how to transport the air to a reasonable position in the storage chamber. In airway designs of current air-cooled refrigerators on the market, evaporators in most of the air-cooled refrigerators are arranged in an independent accommodating compartment, and a complicated air passage system is used to communicate the accommodating compartment of the evaporator to respective storage chambers, which causes that the design of the existing air duct system is relatively complicated and the structure is relatively large. In addition, due to the limitation of the existing air duct system structure, the air cannot be transported to an expected position.

SUMMARY

One object of the application is to provide a novel refrigerator to solve one of the above defects of the existing air-cooled refrigerators. The refrigerator comprises a special air duct system that enables the refrigerator to have a reasonable structure design and transport the air effectively.

In particular, the application provides a refrigerator. The refrigerator comprises:

a cabinet having a cooling chamber and at least one storage chamber; and an air duct assembly installed on the cabinet, wherein the air duct assembly has a plurality of air duct layers sequentially arranged in a longitudinal direction of the cabinet; and each of the air duct layers has one or more air ducts; and an airflow flowing out of the cooling chamber flows to the at least one storage chamber through the one or more air ducts of each of the air duct layers.

Optionally, the refrigerator further comprising:

an air discharger having a peripheral wall portion, a first axial end portion arranged at a front end of the peripheral wall portion, and a second axial end portion arranged at a rear end of the peripheral wall portion; wherein a plurality of first air outlets is arranged on the peripheral wall portion, at least one second air outlet is arranged on the first axial end portion, and an air inlet is arranged on the second axial end portion;

the air duct assembly further has an accommodating cavity accommodating the air discharger;

the plurality of air duct layers comprises a first air duct layer and a second air duct layer located at a front side of the first air duct layer, the first air duct layer comprising a plurality of first air ducts, and the second air duct layer comprising one or more second air ducts; and the cooling chamber is located at a rear side of the air duct assembly; the air inlet faces the cooling chamber; the airflow flowing out of the cooling chamber flows to the at least one storage chamber through the plurality of first air outlets of the air discharger and the plurality of first air ducts; and the airflow flowing out of the cooling chamber flows to the at least one storage chamber through the at least one second air outlet of the air discharger and the one or more second air ducts.

Optionally, the air duct assembly further has a first air supply opening arranged at a tail end of each of the first air ducts and facing forwardly, and a second air supply opening arranged at a tail end of each of the second air ducts and facing forwardly.

Optionally, the accommodating cavity is located at a central portion or an upper portion of the air duct assembly;

the plurality of first air outlets comprise an air outlet I, an air outlet II, and an air outlet III, the air outlet I being arranged at a lower side of the peripheral wall portion, and the air outlet II and the air outlet III being arranged at two sides of the air outlet I;

the plurality of first air ducts comprise an air duct I, an air duct II, an air duct III, and an air duct IV;

the air duct I extends from the air outlet II to one transverse side of the upper portion of the air duct assembly; and after extending upwards from the air outlet II, the air duct II extends from an upper side of the accommodating cavity to another transverse side of the upper portion of the air duct assembly;

the air duct III extends downwards from the air outlet I;

the air duct IV extends downwards from the air outlet III, and a tail end of the air duct IV is located below a tail end of the air duct III;

the plurality of second air ducts comprise an air duct V and an air duct VI; there are a plurality of second air outlets; the second air duct layer further has a collecting cavity arranged at a front side of the first axial end portion and communicated with the plurality of second air outlets; and the air duct V and the air duct VI extend from an upper peripheral wall of the collecting cavity to two transverse sides of the upper portion of the air duct assembly, respectively; and a tail end of the air duct V and a tail end of the air duct VI are both located above the air duct I and the air duct II.

Optionally, the at least one storage chamber comprises an upper tray space, an upper drawer chamber, a lower tray chamber, and a lower drawer chamber sequentially arranged from top to bottom;

the air duct V and the air duct VI are communicated with the upper tray chamber;

the air duct I and the air duct II are communicated with the upper drawer chamber;

the air duct III is communicated with the lower tray chamber; and the air duct IV is communicated with the lower drawer chamber.

Optionally, the air duct assembly comprises a rear housing, a first front cover installed at a front side of the rear housing, and a second front cover installed at a front side of the first front cover;

the first air duct layer and the accommodating cavity are located at a rear side of the first front cover; and the second air duct layer is located at a front side of the first front cover.

Optionally, the rear housing comprises a rear wall, an accommodating cavity wall extending forwards from an upper portion of the rear wall, and a first air duct wall extending forwards from the rear wall;

the first front cover has a cover plate and a second air duct wall extending forwards from the cover plate;

the rear wall, together with the accommodating cavity wall and the cover plate, defines the accommodating cavity; the rear wall, together with the first air duct wall and the cover plate, defines the plurality of first air ducts;

the cover plate, together with the second air duct wall and the second front cover, defines the one or more second air ducts; at least one communication hole is provided on the cover plate, and each of the second air outlets is aligned with one of the communication holes, so that each of the second air outlets is communicated with the one or more second air ducts through one of the communication holes;

the air duct assembly further comprises an air return passage housing extending forwards from a lower end of the rear housing and having one or more air return ducts.

Optionally, the air discharger further comprises:

a centrifugal fan configured to enable airflow to enter the peripheral wall portion from the air inlet.

Optionally, the air discharger further comprises:

an adjusting portion arranged in the peripheral wall portion rotatably with respect to the peripheral wall portion to completely shield, partially shield or completely expose each of the first air outlets at different movement positions, thereby adjusting an air discharging area of each of the plurality of first air outlets.

Optionally, there are a plurality of second air outlets, and the plurality of second air outlets are sequentially arranged in a circumferential direction of the first axial end portion; and one of the first air outlets is arranged on a peripheral wall segment of the peripheral wall portion between every two adjacent second air outlets.

In the refrigerator of the application, the air duct assembly has a plurality layers of air ducts through which the airflow can enter the storage chamber of the refrigerator, especially can reach a plurality of positions of the storage chamber conveniently. This also particularly facilitates the design of the position for transporting the air, thereby allowing the air to be transported to a reasonable position. In addition, each air duct has a relatively short flow path, which can significantly reduce wind resistances, improve smoothness of the air transportation, provide an optimal storage environment for the food, reduce nutrient losses of the food, and decrease power consumptions of the refrigerator, thereby saving the energy and reducing the noise.

Furthermore, in the refrigerator of the application, an air discharger has an adjusting portion, which can adjust the airflow amount at a part or all of the air supply openings, and thereby adjust the cooling capacity transported to the storage chamber. In this way, on one hand, the structure can be simplified. For example, structures, such as, the fan and a plurality of air doors of the existing air-cooled refrigerators can be omitted. On the other hand, the air transporting amount to the storage chamber can be controlled uniformly, which can reasonably allocate the air transporting amount, and improve the refrigerating effect and freshness-keeping effect of the refrigerator. The design of the fan in the air discharger can further enable the refrigerator to have a compact structure, and thereby effectively enlarge the volume of the storage chamber.

A person skilled in the field may better understand the above and other objects, advantages and features of the application from the following detailed description of specific embodiments of the application with reference to the drawings.

BRIEF DESCRIPTION OF THE DRAWINGS

The followings will describe some specific embodiments of the application in detail in an exemplary rather than restrictive manner with reference to the accompanying drawings. The same reference signs in the drawings represent the same or similar parts. The person skilled in the field shall understand that the drawings may not be necessarily drawn according to the scales. In the drawings.

DETAILED DESCRIPTION

Figure 1:
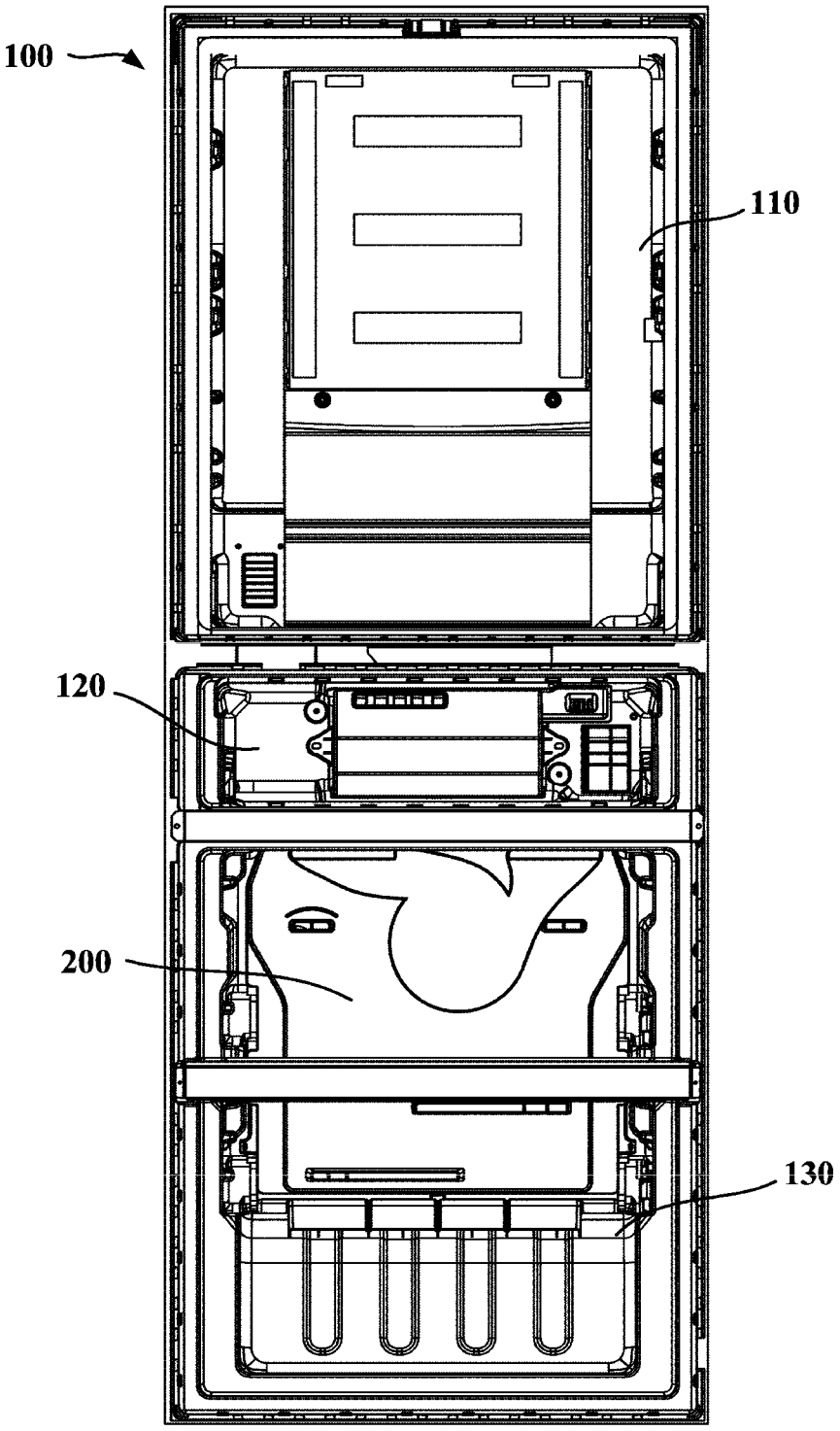
FIG. 1 is a schematic structural view of a refrigerator according to an embodiment of the application.

FIG. 1 is a schematic structural view of a refrigerator according to an embodiment of the application. As shown in FIG. 1, the application provides a refrigerator. The refrigerator may have a cabinet 100, an air duct assembly 200, and a refrigerating system. The cabinet 10 may have a cooling chamber and at least one storage chamber. The refrigerating system may be a compression refrigerating system having an evaporator arranged in the cooling chamber. As known by a person skilled in the field, the refrigerating system may also be other types of refrigerating systems, such as, a semiconductor refrigerating system having a cold end coldness diffuser arranged in the cooling chamber. The air duct assembly 200 may be installed on the cabinet 100, and have a plurality of air duct layers that are sequentially arranged in a longitudinal direction of the cabinet 100. Each of the air duct layers has one or more air ducts; and an airflow flowing out of the cooling chamber flows to the at least one storage chamber through the one or more air ducts of each of the air duct layers.

Figure 2:
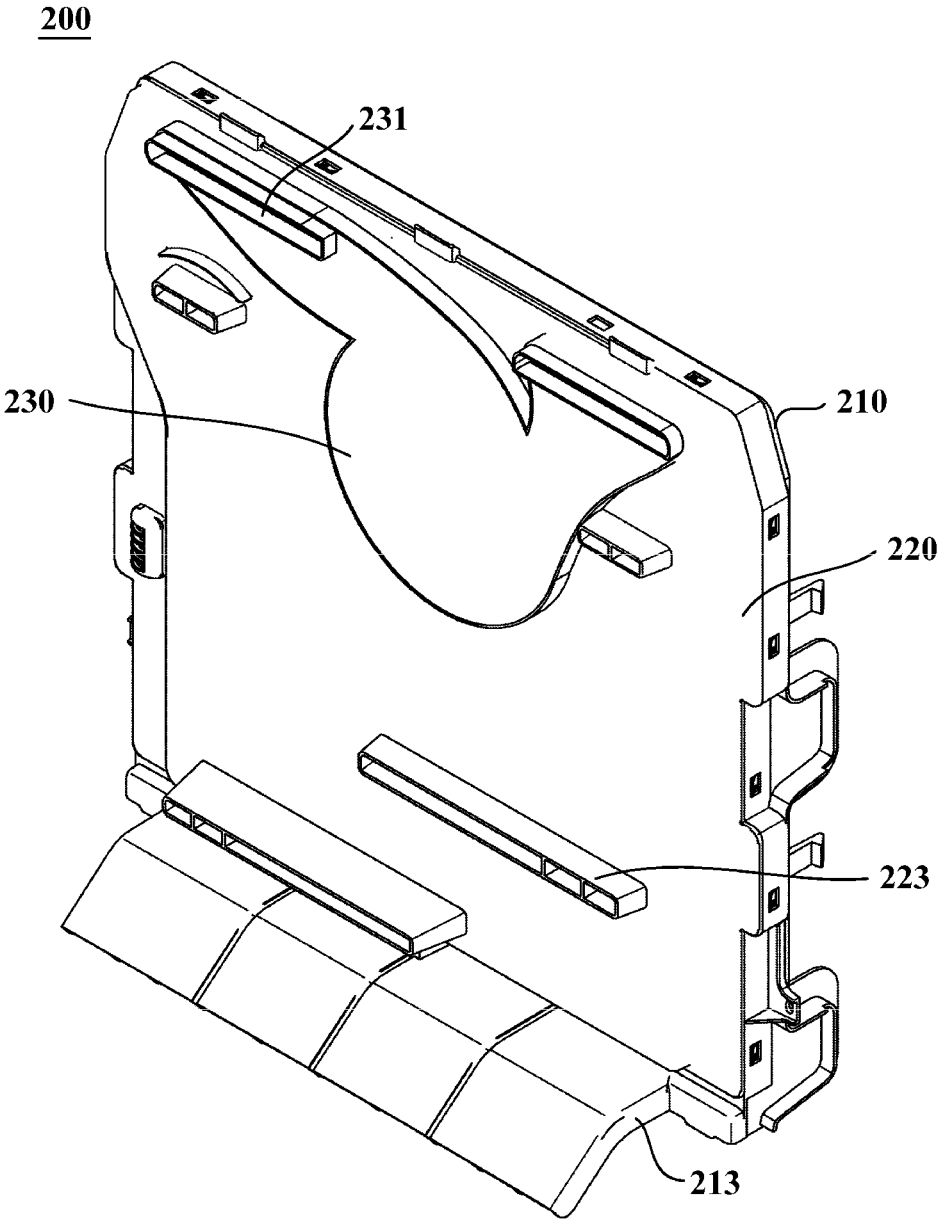
FIG. 2 is a schematic structural view of an air discharger installed on an air duct assembly of the refrigerator shown in FIG. 1.
Figure 3:
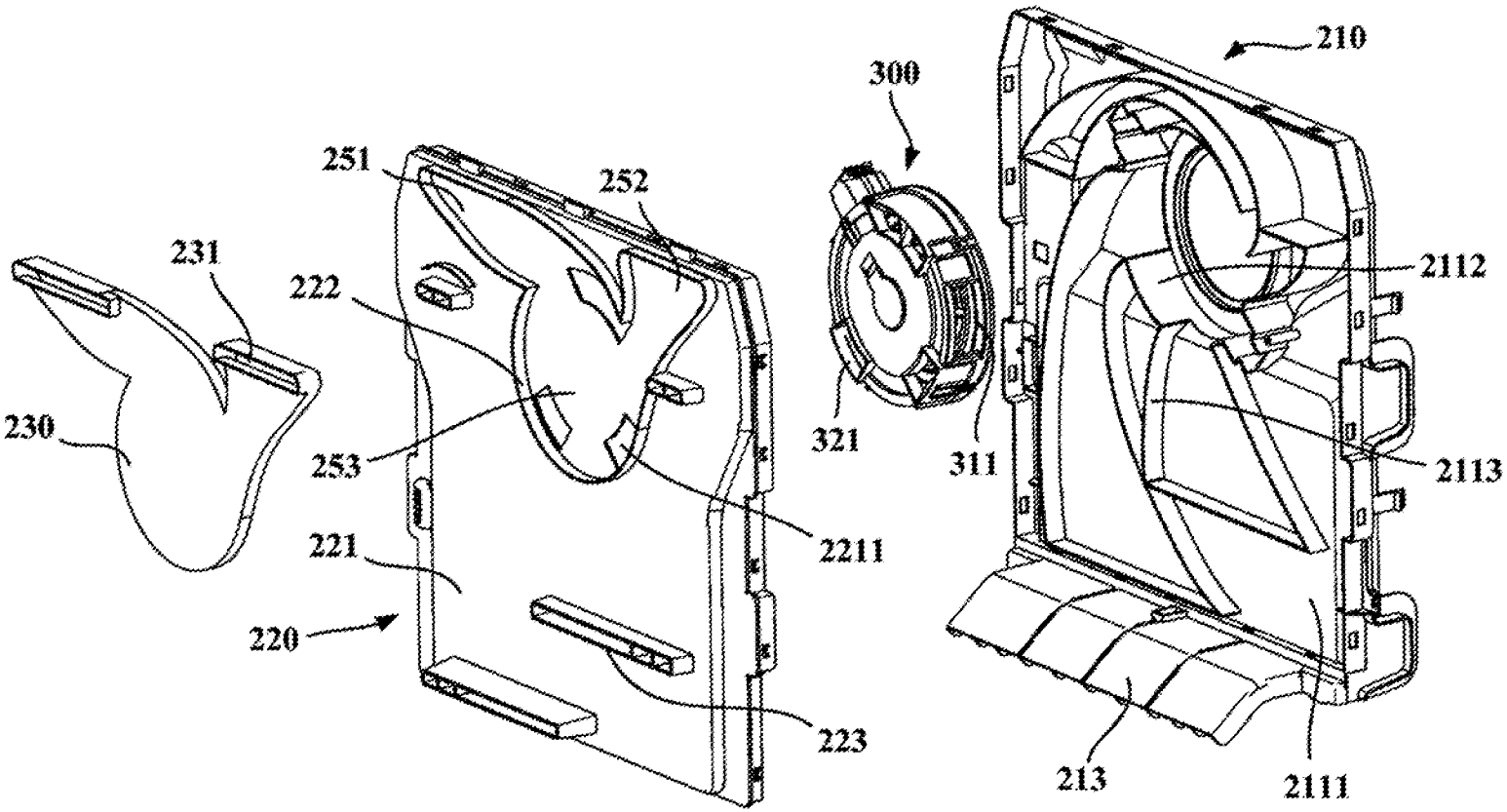
FIG. 3 is a schematic exploded view of the structure shown in FIG. 2.
Figure 4:
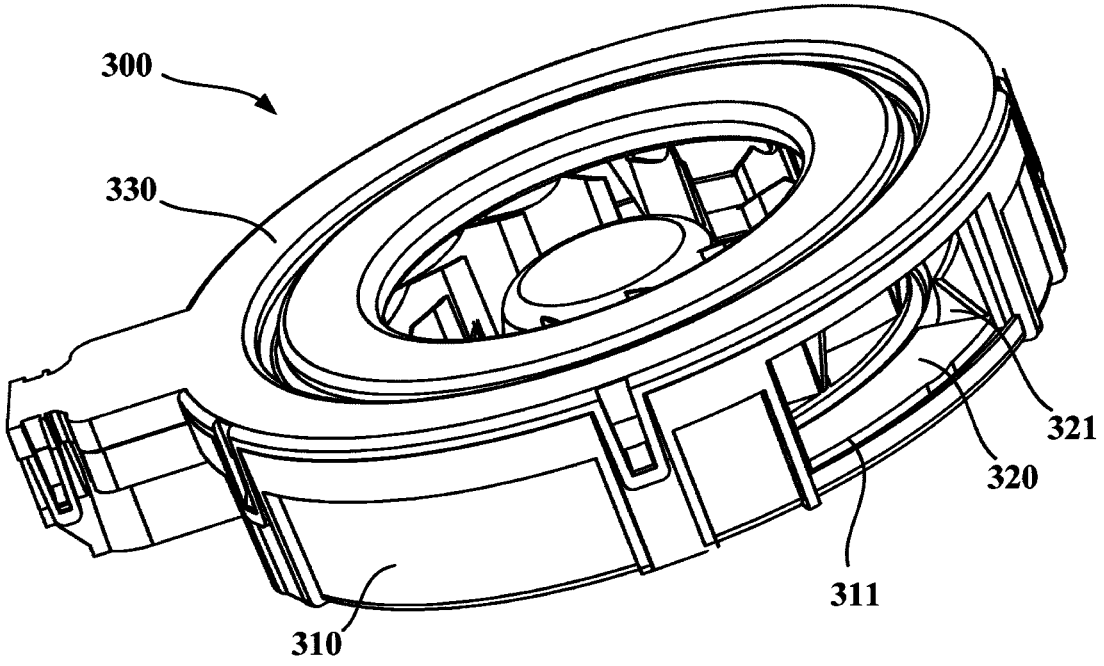
FIG. 4 is a schematic structural view of an air discharger installed on a bottom housing of the air duct assembly shown in FIG. 3.
Figure 5:
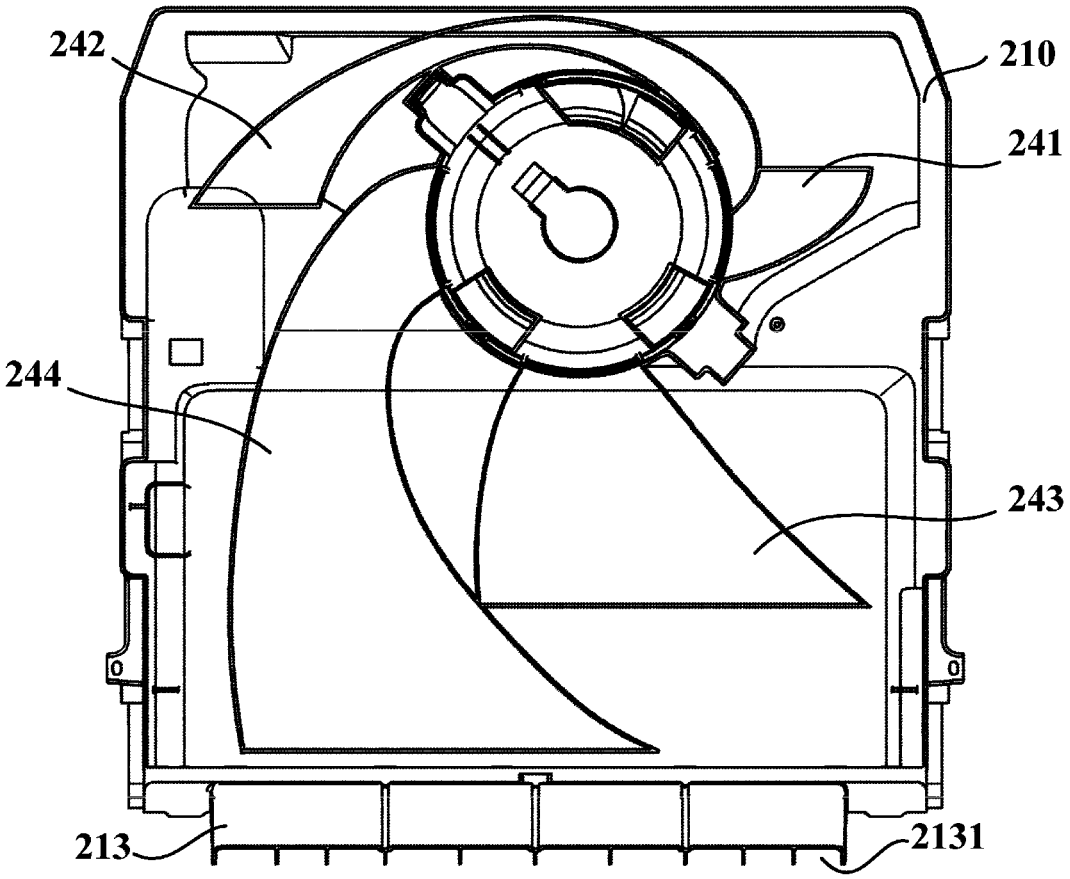
FIG. 5 is a schematic structural view of the air discharger shown in FIG. 3.
Figure 6:
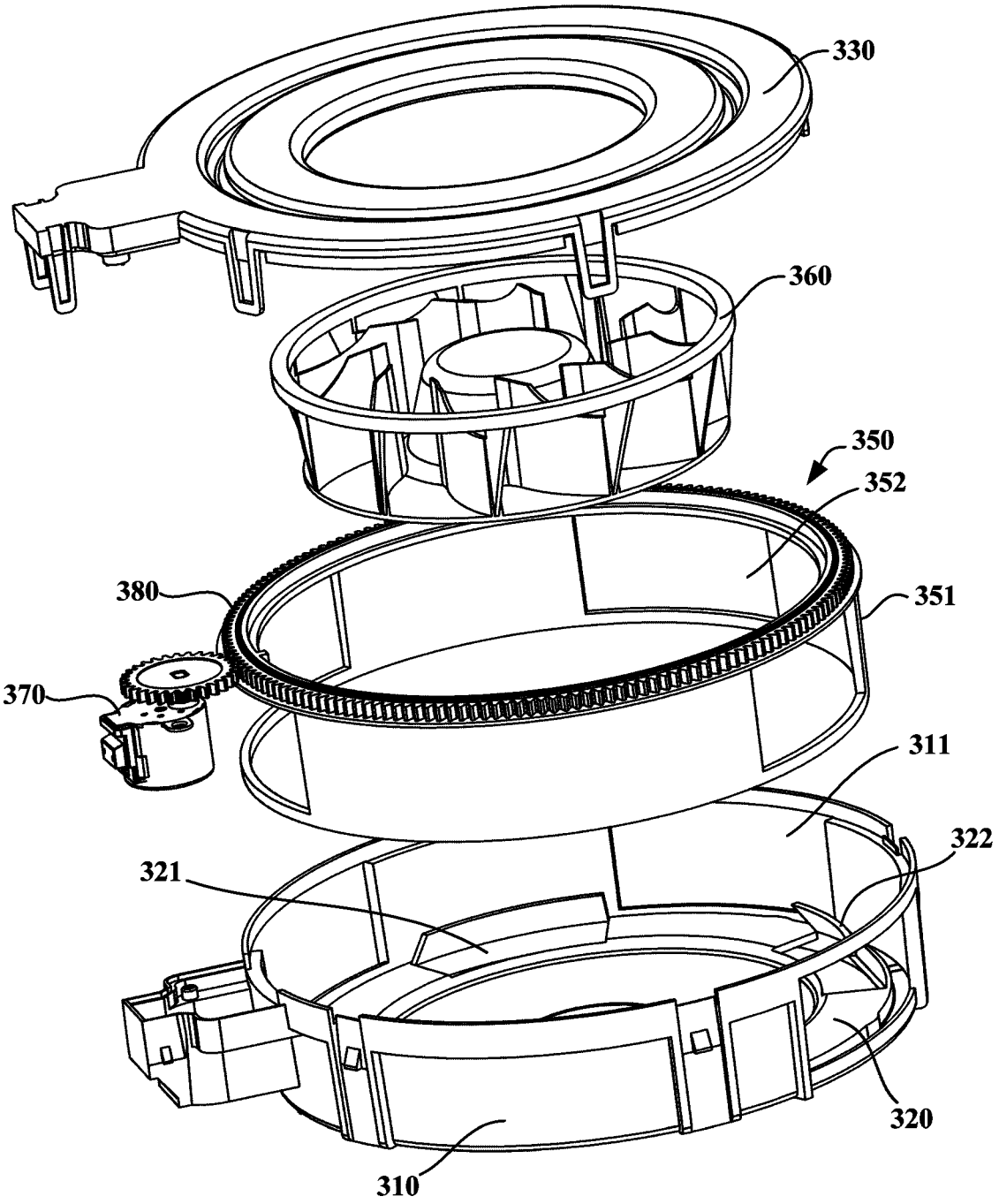
FIG. 6 is a schematic exploded view of the air discharger shown in FIG. 5.

In some embodiments of the application, the refrigerator may further comprise an air discharger 300. The air duct assembly 200 has an accommodating cavity for accommodating the air discharger 300. The plurality of air duct layers may comprise a first air duct layer and a second air duct layer located at a front side of the first air duct layer, as shown in FIG. 2, FIG. 3 and FIG. 4. The first air duct layer comprises a plurality of first air ducts, and the second air duct layer comprises one or more second air ducts. The air discharger 300 is installed in the accommodating cavity of the air duct assembly 200 as shown in FIG. 3. The air discharger 300 may have a peripheral wall portion 310 and a first axial end portion 320 arranged at a front end of the peripheral wall portion 310, as shown in FIG. 5 and FIG. 6. The peripheral wall portion 310 may extend in a longitude direction of the cabinet 100. In other words, the axial direction of the peripheral wall portion 310 extends in the longitudinal direction of the cabinet 100. A plurality of first air outlets 311 is arranged on the peripheral wall portion 310, and at least one second air outlet 321 is arranged on the first axial end portion 320. The airflow flowing out of the cooling chamber flows to the at least one storage chamber through the plurality of first air outlets 311 of the air discharger 300 and the plurality of first air ducts of the air duct assembly 200. The airflow flowing out of the cooling chamber flows to the at least one storage chamber through the at least one second air outlets 321 of the air discharger 300 and the one or more second air ducts of the air duct assembly 200.

For example, in some embodiments of the application, the at least one storage chamber may comprise a refrigerating chamber 110 located at an upper position and a freezing chamber 130 located at a lower position, and the freezing chamber 130 may be divided into four layers of chambers sequentially arranged from top to bottom. In some optional embodiments, the four layers of chambers that are sequentially arranged from top to bottom may be an upper tray chamber, an upper drawer chamber, a lower tray chamber, and a lower drawer chamber. That is, the at least one storage chamber comprises the upper tray chamber, the upper drawer chamber, the lower tray chamber, and the lower drawer chamber that are sequentially arranged from top to bottom, and the refrigerating chamber 110 that is arranged above the upper tray chamber. A tray may be installed in both of the upper tray chamber and the lower tray chamber; and a drawer may be installed in both of the upper drawer chamber and the lower drawer chamber. A switchable chamber 120 may be arranged between the refrigerating chamber 110 and the freezing chamber 130, and they may be spaced from each other by a partition plate; and a partition plate is also arranged between the upper drawer chamber and the lower tray chamber. In some alternative embodiments, the four layers of chambers that are sequentially arranged from top to bottom may be partitioned merely by a partition plate.

Furthermore, in some embodiments, the plurality of first air ducts of the first air duct layer may be communicated with the freezing chamber at a plurality of positions of the freezing chamber, and the one or more second air ducts of the second air duct layer may also be communicated with the freezing chamber at a plurality of positions of the freezing chamber. In some other embodiments, the plurality of first air ducts of the first air duct layer may be communicated with the freezing chamber at a plurality of positions of the freezing chamber, and the one or more second air ducts of the second air duct layer may be communicated with the refrigerating chamber. The special structures of the air discharger 300 and the air duct assembly 200 allow the airflow to enter the storage chamber of the refrigerator through two layers of air ducts, especially to reach a plurality of positions of the storage chamber conveniently. This also particularly facilitates the design of the position for transporting the air, thereby allowing the air to be transported to a reasonable position. The position designs of the first air outlet 311 and the second air outlet 321 of the air discharger 300 particularly make it convenient for transporting air to the two layers of air ducts. Thus, the design is reasonable, and the structure is compact.

Furthermore, as shown in FIG. 5 and FIG. 6, the air discharger 300 may further comprise a second axial end portion 330 arranged at a rear end of the peripheral wall portion 310. An air inlet is arranged on the second axial end portion 330. Preferably, the cooling chamber is located at a rear side of the air duct assembly 200. The opening of the accommodating space faces backwards, and the air inlet faces the cooling chamber to make the structure of the refrigerator more compact.

In some embodiments of the application, each one of a part or all of the first air outlets 311 is communicated with two first air ducts to allow the airflow flowing out of the first air outlet 311 to flow to two transverse sides of the rear portion of the storage chamber, so that the airflow can be distributed in the storage compartment as evenly as possible.

In some embodiments of the application, as shown in FIG. 3 and FIG. 4, the air duct assembly 200 further has a first air supply opening 223 arranged at a tail end of each of the first air ducts and facing forward, and a second air supply opening 231 arranged at a tail end of each of the second air ducts and facing forward. A storage chamber may be located at the front side of the air duct assembly 200, which makes it rather convenient since the air can be transported to the storage chamber conveniently. For example, a freezing chamber is located at the front side of the air duct assembly 200, and the air duct assembly 200 is used to transport the airflow to the freezing chamber. In some alternative embodiments of the application, the air supply opening of a part of the first air ducts or the air supply opening of a part of the second air ducts may be located at an upper end surface of the air duct assembly to facilitate the communication with other air ducts, thereby transporting air to the refrigerating chamber or other chambers.

In some embodiments of the application, as shown in FIG. 3 and FIG. 4, the accommodating cavity is located at a middle portion or an upper portion of the air duct assembly 200. The plurality of first air outlets comprises an air outlet I, an air outlet II, and an air outlet III. The air outlet I is arranged at a lower side of the peripheral wall portion 310, and the air outlet II and the air outlet III are arranged at two sides of the air outlet I. The plurality of first air ducts comprises an air duct I 241, an air duct II 242, an air duct III 243, and an air duct IV 244. The air duct I 241 extends from the air outlet II to one transverse side of the upper portion of the air duct assembly 200. After extending upwards from the air outlet II, the air duct II 242 extends from an upper side of the accommodating cavity to another transverse side of the upper portion of the air duct assembly 200. The air duct III 243 extends downwards from the air outlet I. The air duct IV 244 extends downwards from the air outlet III, and a tail end of the air duct IV 244 is located below a tail end of the air duct III 243. The plurality of second air ducts comprises an air duct V 251 and an air duct VI 252. There is a plurality of second air outlets. The second air duct layer further has a collecting cavity 253 arranged at a front side of the first axial end portion 320 and communicated with the plurality of second air outlets. The air duct V 251 and the air duct VI 252 extend from an upper peripheral wall of the collecting cavity 253 to two transverse sides of the upper portion of the air duct assembly 200, respectively. A tail end of the air duct V 251 and a tail end of the air duct VI 252 are both located above the air duct I 241 and the air duct II 242. Furthermore, the air duct V 251 and the air duct VI 252 are communicated with the upper tray chamber. The air duct I 241 and the air duct II 242 are communicated with the upper drawer chamber. The air duct III 243 is communicated with the lower tray chamber. The air duct IV 244 is communicated with the lower drawer chamber.

In some embodiments of the application, as shown in FIG. 3 and FIG. 4, the air duct assembly 200 may comprise a rear housing 210, a first front cover 220 installed at a front side of the rear housing 210, and a second front cover 230 installed at a front side of the first front cover 220. The first air duct layer and the accommodating cavity are located at a rear side of the first front cover 220. The second air duct layer is located at a front side of the first front cover 220. The first front cover 220 may be engaged with the rear housing 210, and the second front cover 230 may be fixed to the first front cover 220 and the rear housing 210 by a fixing device, such as screws. The rear housing 210 may be engaged with the cabinet 100.

Furthermore, the rear housing 210 may have a rear wall 2111, an accommodating cavity wall 2112 extending forwards from a middle portion or an upper portion of the rear wall 2111, and a first air duct wall 2113 extending forwards from the rear wall 2111. The first front cover has a cover plate 221 and a second air duct wall 222 extending forwards from the cover plate 221. The rear wall 2111, together with the accommodating cavity wall 2112 and the cover plate 221, defines the accommodating cavity. The rear wall 2111, together with the first air duct wall 2112 and the cover plate 221, defines the plurality of first air ducts. The cover plate 221, together with the second air duct wall 222 and the second front cover 230, defines the one or more second air ducts. At least one communication hole 2211 is arranged on the cover plate 221, and each of the second air outlets 321 is aligned with a communication hole 2211, so that each of the second air outlets 321 is communicated with the one or more second air ducts through a communication hole 2211. Specifically, each of the second air outlets 321 is communicated with the collecting cavity 253 through a communication hole 2211. The number of the second air outlets 321 may be three.

In some further embodiments of the application, at least a tail end portion of each of the first air ducts is gradually enlarged along a flowing direction of the airflow, so that each of the first air supply openings 223 may be a stripe-shaped air supply opening extending longitudinally in a horizontal direction. A partition plate is also arranged in each of the first air supply openings 223, so that each of the air supply openings has a plurality of air transporting small holes. Each of the first air supply openings 223 may be arranged on the cover plate 221. Each of the second air supply openings 231 may also be stripe-shaped air supply openings extending longitudinally in a horizontal direction, and may be arranged on the second front cover 230. Furthermore, an air return duct housing 213 is arranged at the lower end of the rear housing 210, and the air return duct housing 213 extends forwards and has one or more air return ducts 2131. The air return duct housing 213 firstly extends forwards and then extends downwards obliquely to fit a compressor compartment at a lower portion of the cabinet 100.

In some embodiments of the application, the rear wall 2111 of the rear housing 211 may comprise a lower-middle wall portion, an upper wall portion, and a connecting wall portion. The lower-middle wall portion is located at the front side of the upper wall portion, and the connecting wall portion connects the upper end of the lower-middle wall portion and the lower end of the upper wall portion. This arrangement may provide a relatively large space for placing the evaporator or the like, and also facilitates the installation of the air discharger 300. Thus, the design is particularly reasonable.

In some alternative embodiments of the application, a plurality of third air supply openings that face forwards may be arranged on the cover plate 221, and each of the third air supply openings may communicate with any position between the head end and the tail end of a corresponding first air duct. That is, several first air ducts may not only communicate with the storage chamber at the tail end of the first air ducts, but may also communicate with the storage chamber at other locations thereof. Similarly, a plurality of fourth air supply openings that face forwards may be arranged on the second front cover 230, and each of the fourth air supply openings may communicate with any position between the head end and the tail end of a corresponding second air duct.

In some embodiments of the application, as shown in FIG. 5 and FIG. 6, the air discharger 300 may further comprise a fan 360 configured to cause the airflow to enter the peripheral wall portion 310 from the air inlet. The fan 360 is preferably configured as a centrifugal fan. The design of the fan 360 in the air discharger 300 can further enable the refrigerator to have a compact structure, and can effectively enlarge the volume of the storage chamber. In some preferred embodiments of the application, the air discharger 300 may further comprise an adjusting portion 350 that is arranged in the peripheral wall portion 310 rotatably with respect to the peripheral wall portion 310 to completely shield or partially shield or completely expose each of the first air outlets 311 at different movement positions, thereby adjusting an air discharging area of each of the plurality of first air outlets 311. The arrangement of the adjusting portion 350 allows a uniform control of the air transporting amount to the storage chamber, which can reasonably allocate the air transporting amount, and improve the refrigerating effect and freshness-keeping effect of the refrigerator.

In some embodiments of the application, the peripheral wall portion 310 preferably has a cylindrical shape, and may be integrally formed with one of the first axial end portion 320 and the second axial end portion 330, with the other thereof being engaged with the peripheral wall portion 310. The integrated structure of the peripheral wall portion 310, the first axial end portion 320, and the second axial end portion 330 may also be referred to as a housing of the air discharger 300. The plurality of second air outlets 321 are sequentially arranged in a circumferential direction of the first axial end portion 320, preferably arranged evenly in sequence. Certainly, the plurality of second air outlets 321 may be arranged unevenly in a circumferential direction of the first axial end portion 320. Furthermore, the first axial end portion 320 comprises a central portion and an outer peripheral portion at an outer side of the central portion. To facilitate air discharging, each of the second air outlets 321 is arranged at the outer peripheral portion. The fan 360 may be installed in the central portion. Preferably, each of the second air outlets 321 may have a shape of an annular segment extending in a circumferential direction of the first axial end portion 320.

In some embodiments of the application, a first air outlet 311 is arranged on a peripheral wall segment of the peripheral wall portion 310 between every two adjacent second air outlets 321. In this way, the airflow entering the peripheral wall portion 310 can be fully utilized, so that the amount of the airflow entering the second air outlets 321 and the smoothness of the air discharging can be ensured. In addition, the airflow entering the first air outlets 311 and the airflow entering the second air outlets 321 can be prevented from interfering each other, thereby preventing the occurrence of undesirable phenomena such as loud noise.

In order to cause each of the second air outlets 321 to discharge air axially as far as possible, that is, to configure each of the second air outlets 321 to discharge the air axially, the outer peripheral portion may be arranged to comprise a flat plate portion and at least one guiding portion 322. At least one second air outlet 321 is arranged on the flat plate portion. Furthermore, in some embodiments, each of the guiding portions 322 extends obliquely to an inner side of the first axial end portion 320 and toward an axis of the peripheral wall portion 310 from an edge of the second air outlet 321 adjacent to the peripheral wall portion 310. The guiding portions 322 may have a plate shape and may also be referred to as guiding plates. Furthermore, a guiding shield plate may also be arranged at both ends of each of the guiding portions 322. In some embodiments, each of the guiding portions 322 extends obliquely to an outer side of the first axial end portion 320 in a direction away from the axis of the peripheral wall portion 310 from the edge of the second air outlet 321 away from the peripheral wall portion 310. The guiding portions 322 may have a plate shape and may also be referred to as guiding plates. Furthermore, a guiding shield plate may also be provided at both ends of each of the guiding portions 322. Inclination angles of the guiding portions 322 may be 30° to 60°, preferably 40°, 43°, 47°, 50°, or the like. The central portion may have a flat plate shape. In some alternative embodiments, the guiding portions 322 may only be configured as guiding surfaces that guide the flow of the airflow, so as to simplify the structure of the first axial end portion 320 or to facilitate the design of the first axial end portion 320.

In some embodiments of the application, the adjusting portion 350 may comprise one or more shielding portions 351 arranged at intervals in the circumferential direction of the first axial end portion 320, and at least one circulating portion 352. The shielding portions 351 and the circulating portion 352 are sequentially arranged in the circumferential direction of the first axial end portion 320, and a cylindrical structure is formed by the enclosure of the one or more shielding portions 351 and the at least one circulating portion 352 together. In addition, the adjusting portion 350 is arranged at an inner side of the peripheral wall portion 310, and can be rotated to different rotating positions to enable the one or more shielding portions 351 to completely shield or partially shield or completely expose each of the first air outlets 311, so that the airflow can enter the partially shielded or completely exposed first air outlets 311 through the at least one circulating portion 352.

Specifically, the shielding portion 351 may be configured as a shielding sheet, and intervals, notches or holes between every two adjacent shielding sheets may be the circulating portions 352. In particular, when there is only one shielding portion 351, there is also only one corresponding circulating portion 352. For example, the adjusting portion 350 may comprise a base portion and a shielding sheet arranged on the base portion. For another example, the adjusting portion 350 may comprise a cylindrical member, and the cylindrical member is provided with a plurality of circulating portions 352. The base portion may be arranged on both ends of the cylindrical member to enhance the strength. Furthermore, optionally, the base portion may be rotatably installed to the first axial end portion 320 or the second axial end portion 330. For example, an annular groove is arranged at an inner surface of the first axial end portion 320 or the second axial end portion 330, and an annular protrusion corresponding to the annular groove may be arranged on the base portion to insert into the annular groove for rotation. Further optionally, the base portion may be rotatably installed to an end of the peripheral wall portion 310. When the peripheral wall portion 310 is integrally formed with the first axial end portion 320, the base portion is rotatably installed to the end of the peripheral wall portion 310 near the second axial end portion 330.

In some embodiments of the application, the air discharger 300 may also comprise a motor 370 and a transmission mechanism. The motor 370 may be arranged at an outer side of the peripheral wall portion 310 in a radial direction. The transmission mechanism is configured to transmit the rotational motion output by the motor 370 to the adjusting portion 350. For example, the transmission mechanism may preferably be configured as a gear transmission mechanism. A ring gear 380 is arranged on the base portion of the adjusting portion (the ring gear 380 may be integrally formed with the base portion), and an output end of the motor 370 may be equipped with a gear. The gear meshes with the ring gear 380, so that the motor can drive the ring gear 380 to rotate, thereby driving the adjusting portion 350 to rotate. Furthermore, a motor accommodating portion may be arranged at an outer side of the peripheral wall portion 310 for accommodating the motor 370.

In some specific embodiments of the application, the air outlet II, the air outlet I, and the air outlet III are sequentially arranged at intervals in the circumferential direction of the first axial end portion 320 and in the clockwise direction (taking the sight line of the observer viewing from the first axial end portion 320 to the second axial end portion 330 as a reference, that is, taking a sight line in a front-rear direction as a reference). In addition, the distance between the air outlet II and the other two first air outlets 311 may both be equal to the length of one first air outlet 311. In the adjusting portion 350, the number of both the shielding portions 351 and the circulating portions 352 is three. The three shielding portions 351 include a first shielding portion, a second shielding portion, and a third shielding portion, respectively. The three circulating portions 352 include a first circulating portion, a second circulating portion, and a third circulating portion, Respectively. The shielding portions 351 and the circulating portions 352 are sequentially arranged at intervals in the circumferential direction of the first axial end portion 320 and in the counterclockwise direction. The first shielding portion and the second shielding portion are both configured to be able to completely shield a region with a size of one first air outlet 311. The third shielding portion is configured to be able to at least completely shield a region with a size of two first air outlets 311. For example, the third shielding portion may shield a region with a size of two first air outlets 311. The circulating portion between the first shielding portion and the second shielding portion is configured as the first circulating portion that is configured to completely expose the region with a size of one first air outlet 311. The circulating portion between the second shielding portion and the third shielding portion is configured as the second circulating portion that is configured to completely expose the region with a size of one first air outlet 311. The circulating portion between the third shielding portion and the first shielding portion is configured as the third circulating portion. During the operation, the adjusting portion 350 may be rotated to cause different first air outlets 311 to be in an open state. For example, when the first shielding portion shields the air outlet I, the air outlet II and the air outlet III may both be in an open state. For another example, when the second shielding portion shields the air outlet I, the air outlet II and the air outlet III may both be in a closed state.

In some alternative embodiments of the application, the distance between the air outlet I and the other two first air outlets 311 may both be equal to 1/7 to 1/10 of the length of one first air outlet 311. In the adjusting portion 350, the number of both the shielding portions 351 and the circulating portions 352 is two. The two shielding portions 351 include a first shielding portion and a second shielding portion, respectively. The two circulating portions 352 include a first circulating portion and a second circulating portion, respectively. The shielding portions 351 and the circulating portions 352 are sequentially arranged at intervals in the circumferential direction of the first axial end portion 320 and in the clockwise direction. The first shielding portion is configured to be able to completely shield one first air outlet 311. The second shielding portion is configured to be able to at least completely shield two first air outlets 311. For example, the second shielding portion may shield three first air outlets 311 and a connecting segment of the peripheral wall portion 310 between every two first air outlets 311. The first circulating portion is configured to completely expose one first air outlet 311. The second circulating portion is configured to completely expose three first air outlets 311. During the operation, the adjusting portion 350 may be rotated to cause different first air outlets 311 to be in an open state. For example, when the first shielding portion shields the air outlet I, the air outlet II and the air outlet III may both be in an open state. For another example, when the first circulating portion conducts the air outlet I, the air outlet II and the air outlet III may both be in a closed state.

In some embodiments of the application, any two of the plurality of first air outlets 311 may have a same or different size; and any two of the plurality of second air outlets 321 may have a same or different size.

So far, a person skilled in the field shall know that although a plurality of exemplary embodiments of the application have been described above in detail, various variations and improvements conforming the principle of the present application can be directly determined or deducted from the content disclosed by the application without departing from the spirit and scope of the application. Therefore, all those variations and improvements shall be deemed to be covered by the scope of the application.

What is claimed is:

1. A refrigerator, comprising:

a cabinet having a cooling chamber and at least one storage chamber; and an air duct assembly installed on the cabinet, wherein the air duct assembly has a plurality of air duct layers sequentially arranged in a longitudinal direction of the cabinet; and each of the air duct layers has one or more air ducts; and an airflow flowing out of the cooling chamber flows to the at least one storage chamber through the one or more air ducts of each of the air duct layers;

an air discharger having a peripheral wall portion, a first axial end portion arranged at a front end of the peripheral wall portion, and a second axial end portion arranged at a rear end of the peripheral wall portion; wherein a plurality of first air outlets is arranged on the peripheral wall portion, at least one second air outlet is arranged on the first axial end portion, and an air inlet is arranged on the second axial end portion;

the air duct assembly further has an accommodating cavity accommodating the air discharger;

the plurality of air duct layers comprises a first air duct layer and a second air duct layer located at a front side of the first air duct layer, the first air duct layer comprising a plurality of first air ducts, and the second air duct layer comprising one or more second air ducts; and the cooling chamber is located at a rear side of the air duct assembly; the air inlet faces the cooling chamber; the airflow flowing out of the cooling chamber flows to the at least one storage chamber through the plurality of first air outlets of the air discharger and the plurality of first air ducts; and the airflow flowing out of the cooling chamber flows to the at least one storage chamber through the at least one second air outlet of the air discharger and the one or more second air ducts.

2. The refrigerator according to claim 1, wherein:

the air duct assembly further has a first air supply opening arranged at a tail end of each of the first air ducts and facing forwardly, and a second air supply opening arranged at a tail end of each of the second air ducts and facing forwardly.

3. The refrigerator according to claim 2, wherein:

the accommodating cavity is located at a central portion or an upper portion of the air duct assembly;

the plurality of first air outlets comprise an air outlet I, an air outlet II, and an air outlet III, the air outlet I being arranged at a lower side of the peripheral wall portion, and the air outlet II and the air outlet III being arranged at two sides of the air outlet I;

the plurality of first air ducts comprise an air duct I, an air duct II, an air duct III, and an air duct IV;

the air duct I extends from the air outlet II to one transverse side of the upper portion of the air duct assembly; and after extending upwards from the air outlet II, the air duct II extends from an upper side of the accommodating cavity to another transverse side of the upper portion of the air duct assembly;

the air duct III extends downwards from the air outlet I;

the air duct IV extends downwards from the air outlet III, and a tail end of the air duct IV is located below a tail end of the air duct III;

the plurality of second air ducts comprise an air duct V and an air duct VI; there are a plurality of second air outlets; the second air duct layer further has a collecting cavity arranged at a front side of the first axial end portion and communicated with the plurality of second air outlets; and the air duct V and the air duct VI extend from an upper peripheral wall of the collecting cavity to two transverse sides of the upper portion of the air duct assembly, respectively; and a tail end of the air duct V and a tail end of the air duct VI are both located above the air duct I and the air duct II.

4. The refrigerator according to claim 3, wherein:

the at least one storage chamber comprises an upper tray space, an upper drawer chamber, a lower tray chamber, and a lower drawer chamber sequentially arranged from top to bottom;

the air duct V and the air duct VI are communicated with the upper tray chamber;

the air duct I and the air duct II are communicated with the upper drawer chamber;

the air duct III is communicated with the lower tray chamber; and the air duct IV is communicated with the lower drawer chamber.

5. The refrigerator according to claim 1, wherein:

the air duct assembly comprises a rear housing, a first front cover installed at a front side of the rear housing, and a second front cover installed at a front side of the first front cover;

the first air duct layer and the accommodating cavity are located at a rear side of the first front cover; and the second air duct layer is located at a front side of the first front cover.

6. The refrigerator according to claim 5, wherein:

the rear housing comprises a rear wall, an accommodating cavity wall extending forwards from an upper portion of the rear wall, and a first air duct wall extending forwards from the rear wall;

the first front cover has a cover plate and a second air duct wall extending forwards from the cover plate;

the rear wall, together with the accommodating cavity wall and the cover plate, defines the accommodating cavity;

the rear wall, together with the first air duct wall and the cover plate, defines the plurality of first air ducts;

the cover plate, together with the second air duct wall and the second front cover, defines the one or more second air ducts; at least one communication hole is provided on the cover plate, and each of the at least one second air outlet is aligned with one of the communication holes, so that each of the at least one second air outlet is communicated with the one or more second air ducts through one of the communication holes;

the air duct assembly further comprises an air return passage housing extending forwards from a lower end of the rear housing and having one or more air return ducts.

7. The refrigerator according to claim 1, wherein the air discharger further comprises:

a centrifugal fan configured to enable airflow to enter the peripheral wall portion from the air inlet.

8. The refrigerator according to claim 1, wherein the air discharger further comprises:

an adjusting portion arranged in the peripheral wall portion rotatably with respect to the peripheral wall portion to completely shield, partially shield or completely expose each of the first air outlets at different movement positions, thereby adjusting an air discharging area of each of the plurality of first air outlets.

9. The refrigerator according to claim 1, wherein:

there are a plurality of second air outlets, and the plurality of second air outlets are sequentially arranged in a circumferential direction of the first axial end portion; and one of the first air outlets is arranged on a peripheral wall segment of the peripheral wall portion between every two adjacent second air outlets.

* * * * *